US008274383B2

(12) United States Patent
Mitchell et al.

(10) Patent No.: US 8,274,383 B2
(45) **Date of Patent: *Sep. 25, 2012**

(54) METHODS AND SYSTEMS FOR SENSING ACTIVITY USING ENERGY HARVESTING DEVICES

(75) Inventors: Bradley J. Mitchell, Snohomish, WA (US); Mark E. Wentland, Lynnwood, WA (US); Bret L. Lamoree, Snohomish, WA (US); James P. Schalla, Edmonds, WA (US)

(73) Assignee: The Boeing Company, Chicago, IL (US)

( * ) Notice: Subject to any disclaimer, the term of this patent is extended or adjusted under 35 U.S.C. 154(b) by 291 days.

This patent is subject to a terminal disclaimer.

(21) Appl. No.: 12/059,508

(22) Filed: Mar. 31, 2008

(65) Prior Publication Data

US 2009/0243842 A1 Oct. 1, 2009

(51) Int. Cl.
*G08B 1/08* (2006.01)

(52) U.S. Cl. ..... 340/539.26; 180/207.1; 320/107

(58) Field of Classification Search ..... 340/438, 340/457, 457.1; 180/268, 269; 320/101, 320/107, 108

See application file for complete search history.

(56) References Cited

U.S. PATENT DOCUMENTS

| | | | | |
|---|---|---|---|---|
| 4,361,741 | A | 11/1982 | Leskoverc et al. | |
| 5,839,174 | A | 11/1998 | Chamings et al. | |
| 5,877,707 | A | 3/1999 | Kowalick | |
| 5,984,350 | A | 11/1999 | Hagan et al. | |
| 6,002,325 | A * | 12/1999 | Conaway | 340/384.1 |
| 6,199,904 | B1 | 3/2001 | Dosdall | |
| 6,215,395 | B1 | 4/2001 | Slaughter et al. | |
| 6,340,864 | B1 | 1/2002 | Wacyk | |
| 6,448,907 | B1 | 9/2002 | Naclerio | |
| 6,476,514 | B1 | 11/2002 | Schondorf | |
| 6,750,764 | B1 | 6/2004 | Henninger | |
| 6,929,218 | B1 | 8/2005 | Sanford et al. | |
| 6,977,582 | B2 * | 12/2005 | Ota et al. | 340/457.1 |
| 7,081,693 | B2 | 7/2006 | Hamel et al. | |
| 7,116,220 | B2 | 10/2006 | Almaraz et al. | |

(Continued)

FOREIGN PATENT DOCUMENTS

EP 0518162 A 12/1992

(Continued)

OTHER PUBLICATIONS

U.S. Appl. No. 11/522,276, Sep. 11, 2006, Mitchell.

(Continued)

*Primary Examiner* — George Bugg
*Assistant Examiner* — Edny Labbees
(74) *Attorney, Agent, or Firm* — Armstrong Teasdale LLP

(57) ABSTRACT

A system for monitoring activities relating to movable and removable items within a vehicle is described. The system includes an electrical energy storage device, an energy harvesting device operable to store harvested energy in the electrical energy storage device, a sensor element configured to output signals corresponding to one or more of removal, installation, and a shift in position of a corresponding item within the vehicle, and a transmitter configured to receive the signals from the sensor element. The transmitter is also configured to transmit unique identification information and data corresponding to the signals received from the sensor element, where the unique identification information corresponds with a location of the item on the vehicle. The sensor element and the transmitter are configured to use energy from one or both of the energy harvesting device and the electrical energy storage device.

20 Claims, 5 Drawing Sheets

U.S. PATENT DOCUMENTS

| | | | | |
|---|---|---|---|---|
| 7,119,671 | B2 * | 10/2006 | Frank et al. | 340/457.1 |
| 7,209,033 | B2 | 4/2007 | Hofbeck et al. | |
| 7,276,703 | B2 | 10/2007 | Berkcan et al. | |
| 7,298,152 | B1 | 11/2007 | Wilke et al. | |
| 7,327,268 | B2 | 2/2008 | Gruteser et al. | |
| 7,343,265 | B2 | 3/2008 | Andarwaris et al. | |
| 7,466,221 | B1 | 12/2008 | Lehr | |
| 7,642,907 | B2 * | 1/2010 | Tang et al. | 340/457.1 |
| 7,765,652 | B2 | 8/2010 | Nakamuru et al. | |
| 2004/0124741 | A1 | 7/2004 | Morrison et al. | |
| 2005/0061568 | A1 * | 3/2005 | Schondorf et al. | 180/268 |
| 2006/0176158 | A1 * | 8/2006 | Fleming | 340/425.5 |
| 2007/0061847 | A1 | 3/2007 | Callahan et al. | |
| 2007/0063847 | A1 | 3/2007 | Lee et al. | |
| 2007/0114422 | A1 | 5/2007 | Berkcan et al. | |
| 2008/0066796 | A1 | 3/2008 | Mitchell et al. | |

FOREIGN PATENT DOCUMENTS

| | | | |
|---|---|---|---|
| GB | 2333070 | A | 7/1999 |
| GB | 2369256 | A | 5/2002 |
| WO | 2007092824 | A2 | 8/2007 |

OTHER PUBLICATIONS

U.S. Appl. No. 11/694,013, Mar. 30, 2007, Mitchell.

U.S. Appl. No. 11/690,316, Mar. 27, 2007, Mitchell.

U.S. Appl. No. 11/862,395, Sep. 27, 2007, Mitchell.

U.S. Appl. No. 12/059,171, Mar. 31, 2008, Mitchell, et al.

International Search Report and Written Opinion of PCT/US2009/030711; Apr. 2, 2009; 14 pages.

* cited by examiner

METHODS AND SYSTEMS FOR SENSING ACTIVITY USING ENERGY HARVESTING DEVICES

BACKGROUND OF THE INVENTION

The field of the invention relates generally to maintaining search and inspection requirements for operation of individual aircraft, and more specifically, to methods and systems for sensing activity using energy harvesting devices.

Many airline procedures are in place to ensure the safety of passengers, crew and equipment. In one instance, a visual inspection process of an airline interior, for example, may include visually looking for opened doors, visually looking for broken tamper evident tapes, and/or manually opening the various doors, panels, and covers generally found within a passenger airliner cabin. The process is conducted to visually inspect the spaces, or volumes, behind these devices, whether or not the doors, panels, and covers have been accessed.

Visually inspecting these spaces and volumes is labor intensive and the process results in an incurred expense for the airline operator. The process may also result in an extended airport gate turn around time. The reality, however, is the vast majority of these spaces have not been accessed or otherwise tampered with. Therefore, the vast majority of visual inspections are not value added.

Airplanes undergo a fairly rigorous inspection in the morning hours preceding the first flight of the day and further inspections are performed while cleaning the airplane between flights resulting in several man-hours per airplane per day. If any areas appear to be tampered with, a more thorough inspection will then be performed.

BRIEF DESCRIPTION OF THE INVENTION

In one aspect, a system for monitoring activities relating to movable and removable items within a vehicle is provided. The system includes an electrical energy storage device, an energy harvesting device operable to store harvested energy in the electrical energy storage device, a sensor element configured to output signals corresponding to one or more of removal, installation, and a shift in position of a corresponding item within the vehicle, and a transmitter configured to receive the signals from the sensor element. The transmitter is also configured to transmit unique identification information and data corresponding to the signals received from the sensor element, where the unique identification information corresponds with a location of the item on the vehicle. The sensor element and the transmitter are configured to use energy from one or both of the energy harvesting device and the electrical energy storage device.

In another aspect, a method for monitoring activities related to one or more items within an aircraft is provided. The method includes configuring the items such that at least one activity associated with the item is operable as a triggering event to a sensor, transmitting a unique identification code associated with the sensor to a monitoring device upon determining that a triggering event has occurred, and correlating the unique identification code with a physical location within an aircraft for purposes of physical inspection.

The features, functions, and advantages can be achieved independently in various embodiments of the present disclosure or may be combined in yet other embodiments in which further details can be seen with reference to the following description and drawings.

DETAILED DESCRIPTION OF THE INVENTION

The methods and systems described herein are helpful in reducing costs and airport gate turnaround time associated with inspections of the various volumes, spaces, and doors associated with an aircraft. More specifically, the methods and systems relate to several specific devices, and associated methods, for wirelessly sensing modification, activity, and/or access events related to volumes, spaces or doors using various energy harvesting or "self-powered" sensors. These sensors are configured to detect and report such modification, activity and access events using wireless communications and the above mentioned battery-free sensors.

Figure 1:
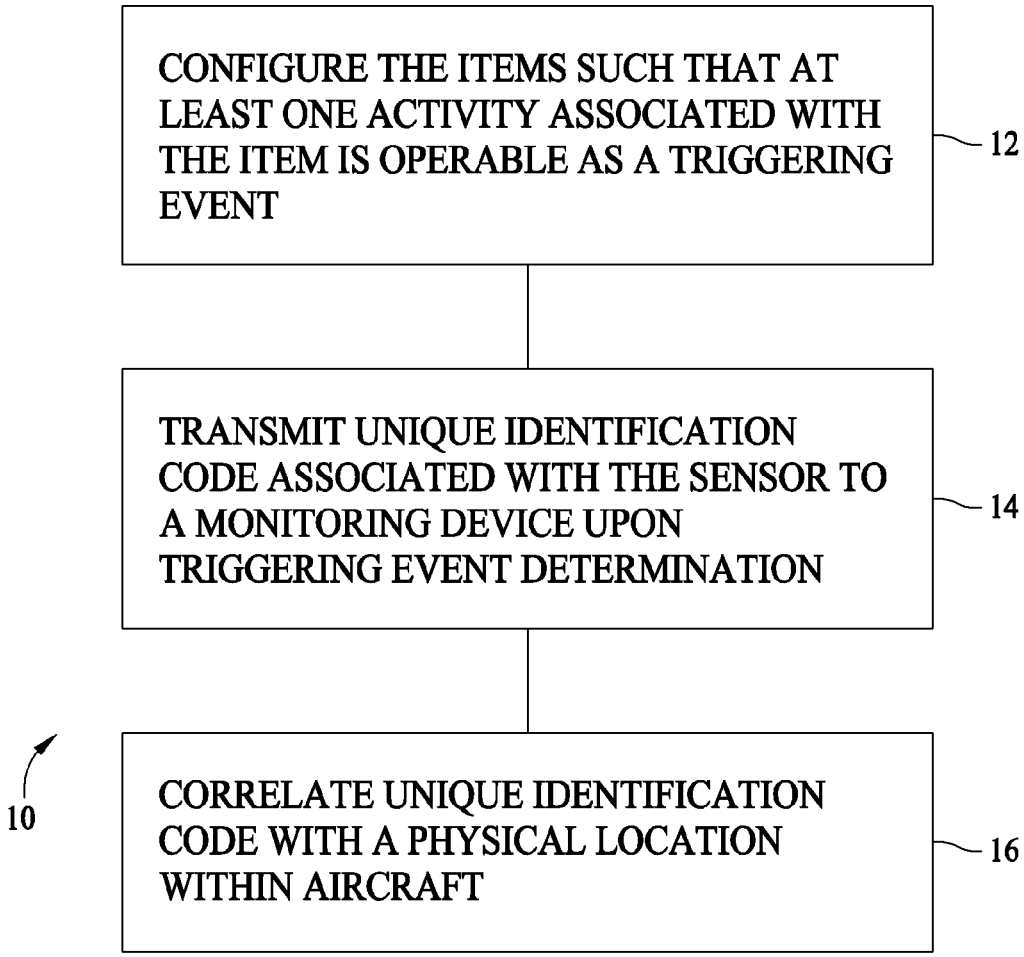
FIG. 1 is a flowchart illustrating a method for monitoring activities related to one or more items within an aircraft.

FIG. 1 is flowchart 10 illustrating a method for monitoring activities related to one or more items within an aircraft. The method illustrated by flowchart 10 includes configuring 12 the items such that at least one activity associated with the item is operable as a triggering event to a sensor, transmitting 14 a unique identification code associated with the sensor to a monitoring device upon determining that a triggering event has occurred, and correlating 16 the unique identification code with a physical location within an aircraft for purposes of physical inspection. In one embodiment, a date and time of the triggering event is recorded in the monitoring device.

Figure 2:
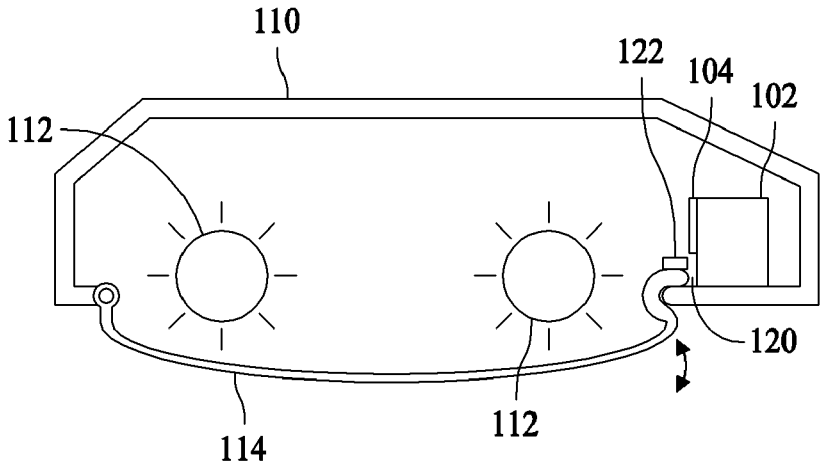
FIG. 2 is a schematic view of a light assembly.

FIG. 2 is a schematic view of a light assembly 100. Light assembly 100 includes a wireless sensor/transmitter 102 that is powered by a photovoltaic cell 104. The wireless sensor/transmitter 102 is installed in a light housing 110 in which one or more lamps 112 are installed, and to which a hinged light bezel 114 is attached. One or more sensors 120, for example, a magnetic reed switch or a mechanical micro-switch, is utilized to sense when the light bezel 114 is in its normally installed position, or if it is fully or partially un-installed.

In operation, sensor 120 is operable to alert the low power, wireless sensor/transmitter 102 of the installation state of the bezel 114 (e.g., if the bezel 114 is in a closed or open position). In one embodiment, the sensor/transmitter 102 is programmed to transmit a unique identification code and a state (open/closed) of the sensor/transmitter 102 whenever the sensed condition changes. The sensor/transmitter 102 may also be programmed to wirelessly transmit it's unique identification code on a periodic basis, whether the state of the sensor 120 has changed or not, to provide a "sign of life" signal. In one embodiment, the low power, wireless sensor/transmitter 102 is installed in the housing 110, behind the light bezel 114.

The wireless sensor/transmitter 102 is powered by the lamps 112 behind the bezel 114. A photovoltaic cell 104, such as an amorphous silicon photovoltaic cell, is exposed to this light source. The cell 104 is utilized to maintain a charge on a battery and/or a capacitor (not shown in the Figure) which may or may not be located within the housing 110 or within the wireless sensor/transmitter 102. The battery and/or super-capacitor provide the energy needed to power the wireless sensor/transmitter 102.

In the figure, a magnetic material 122 is bonded to the hinged light bezel 114 such that it is adjacent to sensor 120 when the bezel 120 is in the closed position. When the bezel 114 is opened (swung downward), the magnetic material 122 moves away from the sensor 120 and the sensor/transmitter 102. In one embodiment, sensor 120 is a magnetic reed switch within the sensor transmitter 102 that senses that the magnetic material 122 is not nearby. When the magnetic material 112 is no longer proximate sensor 120, the reed switch therein changes state, causing the sensor/transmitter 102 to transmit its identification number, and other data indicating that the sensor 120 does not sense the magnetic material 122. Likewise, when the bezel 114 is closed, the sensor 120 senses the presence of the magnetic material (the reed switch again changes state) and the sensor/transmitter 102 transmits its identification number, and other data indicating that the switch is again closed. In one embodiment, a record of each bezel opening and closing occurrence is retained in a monitoring device so appropriate actions can be performed.

Figure 3:
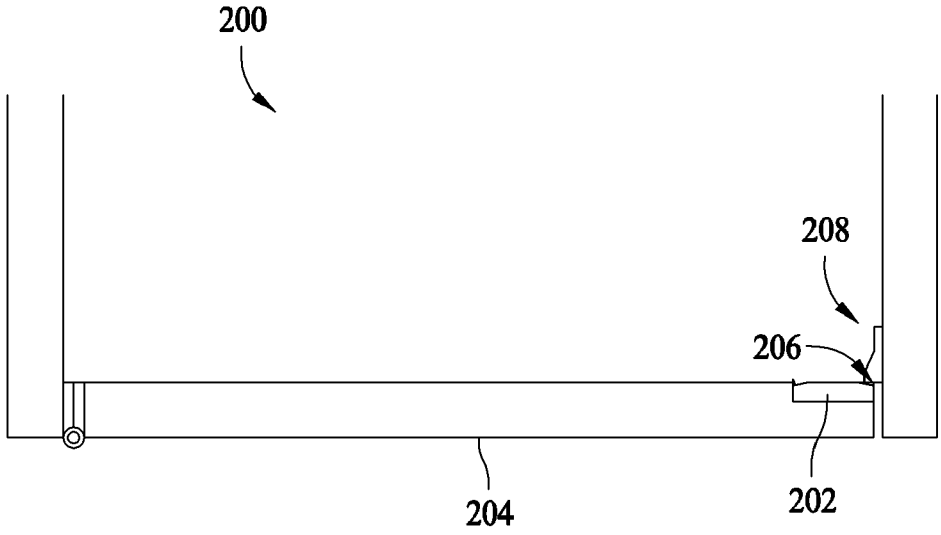
FIG. 3 is a schematic view of a door sensor assembly.

FIG. 3 is a schematic view of a door sensor assembly 200. Door sensor assembly 200 is a mechanically-powered wireless door sensor and transmitter. Specifically, a mechanically-powered wireless sensor/transmitter 202 is installed in a door 204 (as shown) or in door jamb such that the mechanical work in opening and/or closing of the door 204 may be converted into electrical power using a mechanical energy harvester 206 as it compresses and decompresses against a door stop 208. This electrical power is used to transmit, over a wireless channel, an "opened" or "closed" signal, along with a unique identification number associated with the individual sensor/transmitter 202.

In one embodiment, the mechanical energy harvester of door assembly 200 may include a piezoelectric device that is caused to deflect or vibrate by the mechanical work, thus producing an electrical charge in the piezoelectric materials. In another embodiment, a piezoelectric material is bonded to an aircraft structure and is operable to undergo a strain based on a strain experienced by the aircraft structure under varying aircraft operational forces to produce the electrical charge.

In another embodiment, the mechanical energy harvester includes an electro-dynamic device including a coil of wire. A magnetic field is caused to move relative to the coil of wire to produce an electric current in the coil of wire. In one specific embodiment, the polarity of the generated electric charge (or polarity of first half-cycle of AC generated power) may be sensed by the sensor/transmitter 202 to detect whether the door 204 is going through an opening" or "closing" event.

Each wireless sensor/transmitter 202 generally includes one or more sensor(s), a microprocessor, and a radio transmitter. Additionally, each sensor/transmitter 202 includes a small energy storage device, such as a battery and/or a capacitor, in addition to an energy harvesting device. In various embodiments, the energy harvesting device converts ambient energy of one form (force, vibration, heat, flow, light) into electricity to power the sensor/transmitter 202 and/or charge an energy storage device. As a result, the sensor/transmitter 202 is completely wireless and powered either by a small energy storage device and/or by converting ambient energy in its surrounding environment. These energy generation and storage capabilities make the door assembly 200 very easy to install, particularly in a retrofit or after-market scenario, since no power or data wires need to be routed to the door assembly 200.

The sensor/transmitters 202 are, in one embodiment, configured to sample the sensor portion on a schedule (e.g. sample state of door every second). The sensor/transmitter 202 may also be triggered by an external event, related to where it is installed, to sense, for example, the act of physically opening a door. In another example, the sensor/transmitter 202 is configured to conform to a periodic schedule whereby it samples the state of the door every second and wirelessly reports whenever that state has changed, but at least every hour to provide a "sign of life" signal. As another example, the sensor portion of sensor/transmitter 202 is a switch that only awakens the microprocessor when it changes from an open to closed circuit, or visa versa. It is well known in the art of microprocessors to support such a polling or wake-on-demand function. As yet another example, the sensor/transmitter 202 includes a spring-loaded lever that is released when a hatch door is opened. This mechanical spring release action is converted to electricity and activates the sensor/transmitter 202 to transmit a corresponding message that indicates "hatch opened". In this last example, the sensor transmitter 202 is powered by the change of state in the object it is intended to sense.

Figure 4:
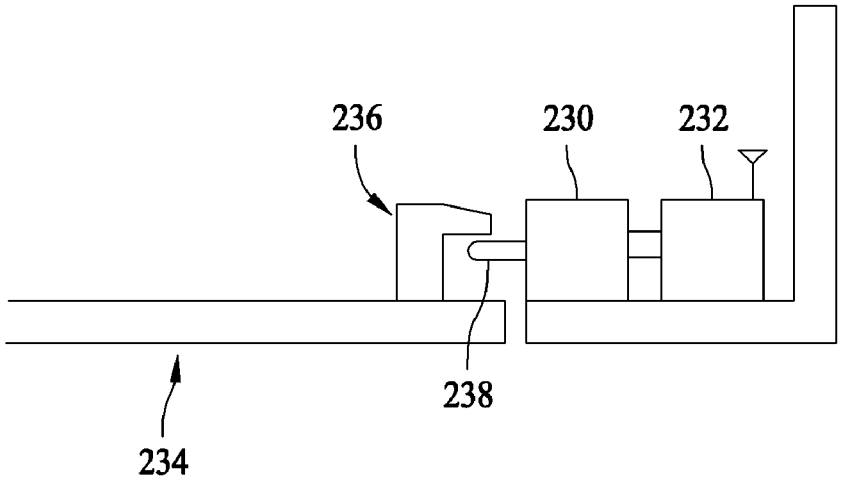
FIG. 4 is a schematic view of a sensor and transmitter combination mounted at an access door.

As illustrated in FIG. 4, a mechanical energy harvester 230 and sensor/transmitter 232 combination may be mounted at an access door 234 such that when the access door 234 is opened or closed, a simple triggering device 236 on the door 234 triggers a spring device 238 such that mechanical energy harvester 230 commences to harvest the mechanical energy caused by the movement of the spring device 238. This operation provides power to the sensor/transmitter 232 which sends a message indicating that the access door 234 has been moved from one position to another. In one embodiment, the mechanical energy harvester 230 includes an electro-dynamic harvesting device. The sensor/transmitter 232 may observe the electrical polarity generated by the mechanical energy harvester 230 (or polarity of first half-cycle of AC generated power) to determine the direction of motion of the triggering device 236.

Another packaging concept includes alternative energy harvesting devices connected to a sensor and transmitter combination, which may consist of, for example, a photovoltaic device exposed to a light source, such as sunlight or cabin lighting, a vibration harvesting device, such as a cantilevered piezoelectric beam, exposed to airplane or operational vibration, or a thermoelectric device exposed to a thermal gradient, such as a hot hydraulic line or the thermal gradient across the airplane insulation blanket as well as a thermoelectric device exposed to a thermal gradient between any two aircraft structures.

Figure 5:
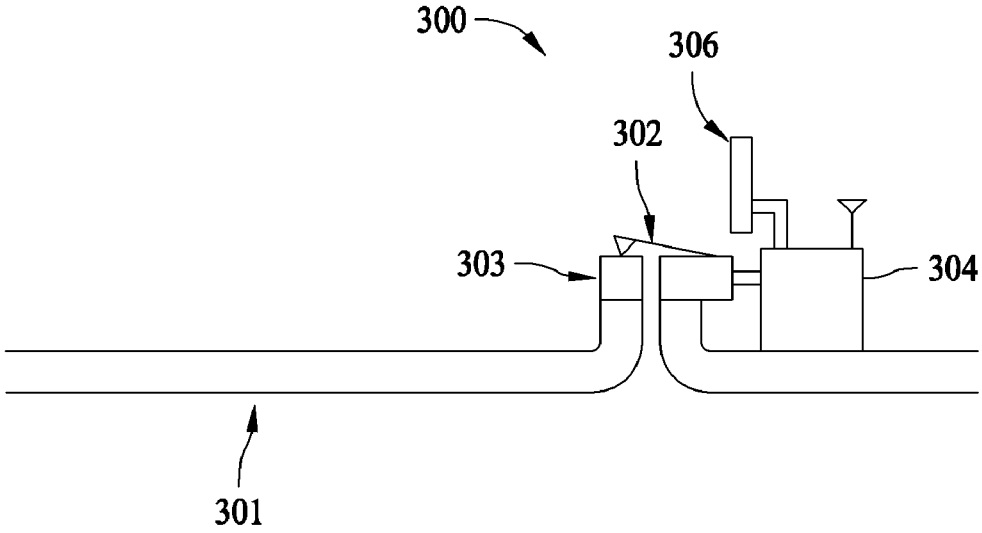
FIG. 5 is a schematic view of an alternative sensor/transmitter configuration.

Another sensor/transmitter configuration 300 is illustrated in FIG. 5. In this configuration, when the door 301 is opened or closed, the state of the micro-switch 302 changes as the land 303 is separated from the micro-switch 302. With the micro-switch 302 connected to input pins of the sensor/transmitter 304, a switching of the micro-switch 302 causes the sensor/transmitter 304 to transmit a data packet consistent with the new state of the micro-switch 302. Alternately, the micro-switch 302 may be connected to the sensor input pins of the sensor/transmitter 304 that are sampled, for example, once per second. In this configuration, the sensor/transmitter 304 transmits the relevant message whenever the state of these input pins is changed. The sensor/transmitter 304 is powered by an energy harvesting device, for example, a solar cell 306 as described above. One sensor/transmitter 304 embodiment is capable of storing over 100 hours of operation time in its on-board capacitors. In another configuration, rather than a micro-switch 302, the sensor/transmitter 304 is configured with a magnetic reed relay, and the land 303 of the door includes a small magnet bonded thereto such that movement of the door 301 in opening and closing causes a change in the electrical state of the magnetic reed relay.

With respect to FIGS. 3, 4, and 5, those skilled in the art will understand that embodiments exist where a photovoltaic cell and an ambient light source are incorporated, rather than the described "mechanical" triggering devices. In such an embodiment, the photovoltaic cell might be mounted so that the light impinges it when a door is opened. One example is a small cutout area and a door jamb. No matter what physical configuration is incorporated, each of the above described sensor/transmitters, when deployed as part of a system is configured with a unique identification number that is included in its transmitted data packet to allow the system to distinguish between sensor/transmitters and associated sensor locations. Through the use of energy harvesting, sensor/transmitters do not require any airplane wiring thereby making them light weight and easy to install. Further, no airplane power or data wiring is required for their normal operation and such devices are virtually maintenance free.

Figure 6:
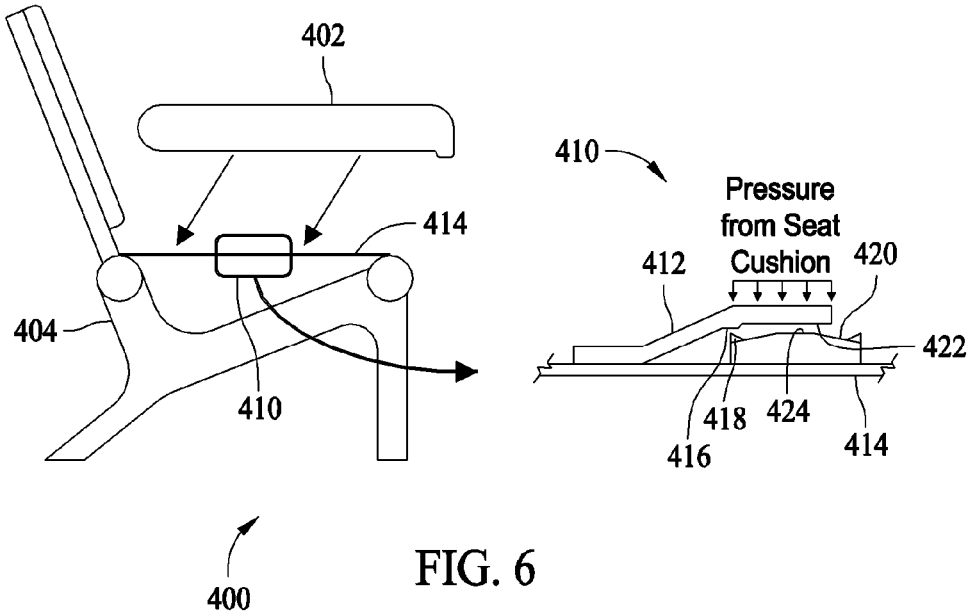
FIG. 6 is a schematic view of a mechanically powered seat sensor assembly.

FIG. 6 is a schematic view of a mechanically powered seat sensor assembly 400. Seat sensor assembly 400 is a mechanically-powered wireless seat sensor and transmitter. Generally, the principles of the various mechanically powered wireless door sensor/transmitters described above are also applied to the sensing of full removal, partial removal, movement, and installation of seat cushions 402 from aircraft seat frames 404. In this embodiment, the mechanical energy harvester 410 is "triggered" by the work of installing or removing the seat cushion 402 from the aircraft seat frame 404, thus causing a signal to be transmitted every time the seat cushion 402 is installed and/or removed.

In the illustrated embodiment of the mechanical energy harvester 410, a flexible lever 412 is attached to the seat pan 414 typically under the seat cushion 402. Installation of the cushion 402 presses the lever 412 down, causing land number one 416 of lever 412 to engage a spring loaded lever 418 and activate a mechanical energy harvesting device within a wireless sensor/transmitter 420 causing it to transmit. Land number two 422 of lever 412 is configured to rest on the top 424 of the sensor/transmitter 420 to carry vertical loads through to the seat pan 414.

Upon removal of the seat cushion 402, flexible lever 412 will rebound, thus releasing the spring loaded lever 418. Release of the spring loaded lever 418 activates a mechanical energy harvesting device within wireless sensor/transmitter 420 causing it to transmit.

Figure 7:
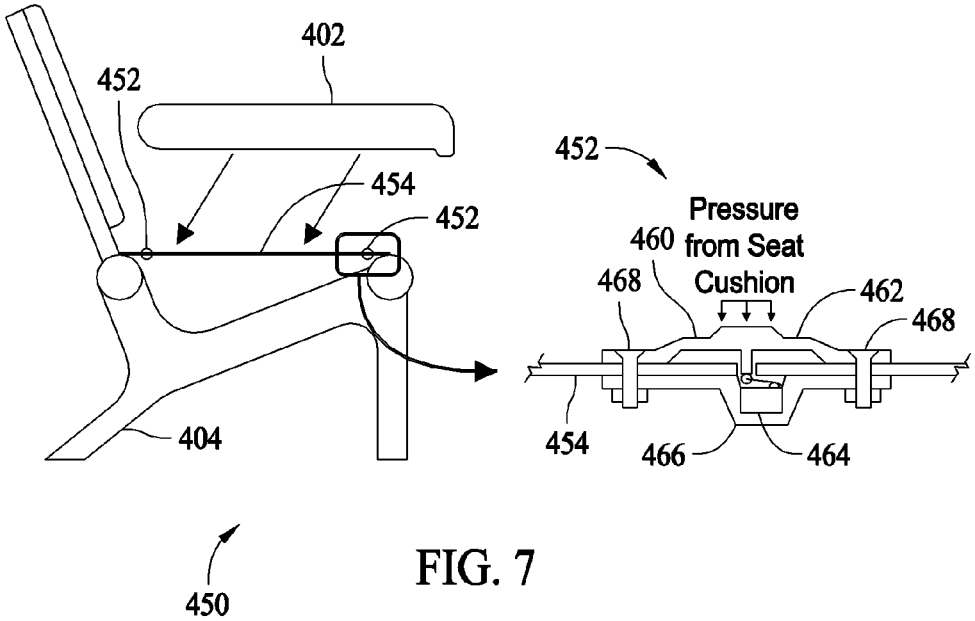
FIG. 7 is a schematic view of a vibration powered seat sensor assembly.

FIG. 7 is a schematic view of a vibration powered seat sensor assembly 450. Seat sensor assembly 450 is a vibration powered seat cushion wireless sensor and transmitter. The principles of the photovoltaic powered light bezel wireless sensor/transmitter described above with respect to light assembly 100 are applied to sensing full removal, partial removal, and installation of seat cushions 402 from aircraft seats 404, except that in this embodiment, the photovoltaic cell is replaced by one or more vibration harvesters 452 installed in the passenger seat pan 454. In various embodiments, the vibration harvester 452 may include a cantilevered piezoelectric beam or electro-dynamic harvester, such that seat vibration is converted to electrical power, which is used to charge a battery or capacitor. A voltage rectification circuit may be incorporated to convert alternating current generated from such devices into direct current that is then utilized to maintain a charge on a battery or capacitor. A low-power wireless sensor, described further in the following paragraph, is utilized to transmit an identification number whenever a state of the sensor changes (e.g. closed circuit changes to open circuit, and visa versa). The illustrated embodiment illustrates two separate vibration harvesting units 452 that include the described sensors and transmitters. In one embodiment, vibration harvesting units 452 located at each corner of the seat pan 454 provides an indication that the cushion 402 has been partially or fully removed.

One sensor configuration is illustrated in FIG. 7. In the illustrated embodiment, a membrane switch 460 is attached to the seat pan 454. The membrane switch 460 includes a pliable plunger 462, which, when pressure is applied, closes a micro-switch 464, thus indicating that pressure (typically from the seat cushion 402) is applied at that location. A housing 466 holds the micro-switch 464 and is attached to the seat pan 454 utilizing fasteners 468 that also pass through the plunger 462 as shown. Such a configuration allows relatively small forces from the seat cushion 402 to be detected while maintaining a low profile above the seat pan 454, thus avoiding hard-points from being transmitted through the cushion 402 to the passenger. Additional seat cushion sensor configurations are contemplated. In one embodiment, the sensor/transmitter and energy storage device are all within the micro-switch unit 464. In alternative embodiments, the energy storage device and sensor/transmitter can be located anywhere on the seat, though locating the devices on or near the seat pan are considered to be advantageous. In one specific embodiment, all four corner sensors (e.g., membrane switches 460) within a seat configuration are connected to a single sensor/transmitter unit and/or a single energy storage unit.

Figure 8:
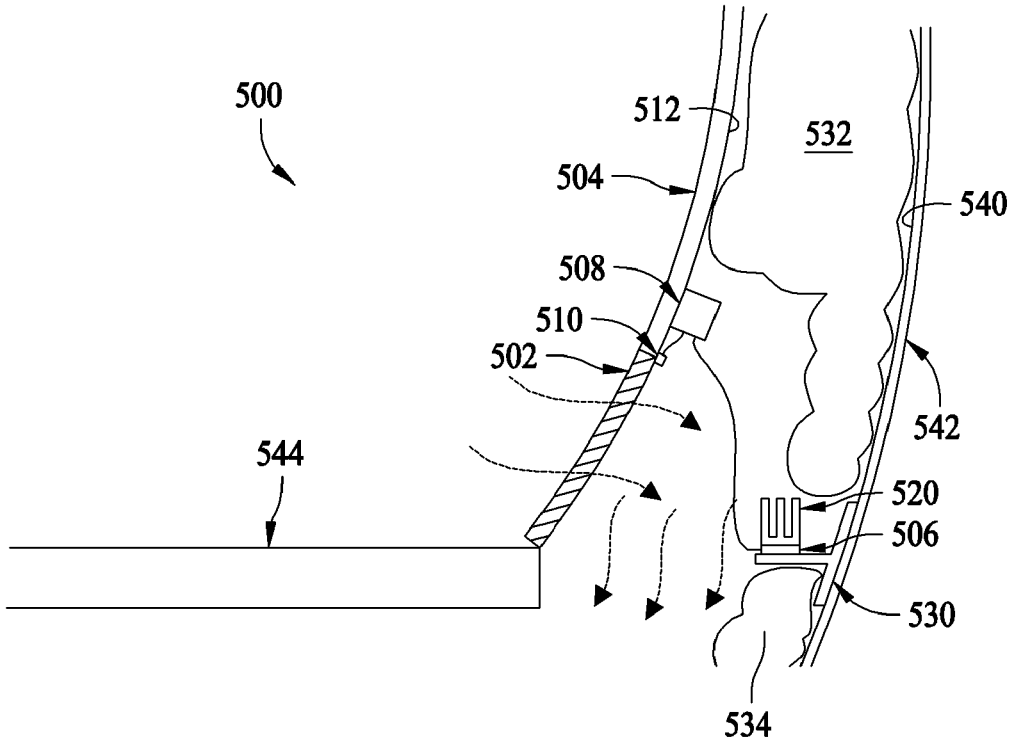
FIG. 8 is a schematic view of a return air grill sensor assembly.

FIG. 8 is a schematic view of a return air grill sensor assembly 500. In the illustrated embodiment, return air grill sensor assembly 500 is a thermoelectric powered return air grill wireless sensor and transmitter.

The principles of the photovoltaic powered light bezel wireless sensor/transmitter described above with respect to light assembly 100 are applied to sensing full removal, partial removal, and installation of cabin return air grills 502 from aircraft cabin side walls 504, except that in this embodiment, the photovoltaic cell is replaced by a thermoelectric generator 506 to provide electrical energy. In the illustrated embodiment, the thermoelectric generator 506 is located within an airplane structure behind or nearby the return air grill 502. The return air is utilized by the thermoelectric generator 506 to charge a battery or capacitor that is located within a transmitter/storage device 508. Transmissions from transmitter/storage device 508 include, for example, a unique identification number for the transmitter and an indication of whether the return air grill 502 is "installed" or "removed" from the cabin side wall 504.

One or more sensors 510 are used to detect when the return air grill 502 is installed, removed or partially removed and such an event results in a transmission being sent by the transmitter/storage device 508. In one embodiment, a magnetic reed switch may be used with, for example, a magnet bonded to the return air grill 502 and a magnetic reed switch mounted on an exterior 512 of the cabin side wall 504 such that the magnet causes the reed switch to close while the return air grill 502 is installed at that location. In the illustrated embodiment, the transmitter/storage device 508 is also mounted to the exterior 512 of the cabin side wall 504. A micro-switch may also be used as a sensor.

As illustrated, the thermoelectric generator 506 and a related heat sink 520 are mounted to a crease beam 530 that lies between two sections of insulation 532, 534 and that is mounted to an interior 540 of the aircraft outer layer 542. Thus, the thermoelectric generator 506 is able to generate electrical power for charging transmitter/storage device 508 from the thermal gradient between the generally warmer return air and the crease beam 506, which is generally colder during flight. Return air grill sensor assembly 500 is operable to allow a wireless transmission to be sent whenever a return air grill 502 is installed, removed or partially removed from the cabin side wall. Though the return air grill is located near the cabin floor 544, it is understood that such grills may be located in other places within an aircraft cabin.

With respect to all of the above described embodiments, a unique transmitter identification number is included in each wireless transmission. The unique transmitter identification number is correlated to the sensor's physical location. Therefore, transmissions from these sensors may be correlated to the associated physical locations. In one embodiment, a report may be generated that provides a listing of all physical locations where a transmission originated due to, for example, movement of a light bezel, or operation of an access door. In addition, the transmissions may be date/time stamped at the receiver with this information included with the report. As a result of such a report, only inspection in the specific physical locations listed in the report may be required, while other locations might not require such an inspection. To provide such a report, a database of sensor identification numbers and corresponding physical location is constructed and maintained, for example, at an airplane level. In addition, it should be noted that all of the above described sensor/transmitter embodiments may be incorporated in configurations where multiple sensors are interfaced to a single transmitter and/or a single energy storage device.

In addition, the above described transmitter devices, which generally are powered by photovoltaic cells, thermoelectric, and/or vibration are also programmed, in certain embodiments, to occasionally transmit a "sign of life" indication, which is useful in maintaining an accurate database of sensors and transmitters and ensuring that the many transmitters that may be implemented on an aircraft are all operational. The transmitters above may also transmit other prognostic information for diagnostic purposes, including, but not limited to, an energy state of on-board energy storage devices (e.g. min/max/average/current battery capacity or capacitor voltage), a state of photovoltaic cells (min/max/average/current voltage), checksum, and a wireless signal strength.

The energy harvesting features and low power configurations described herein provide installation capabilities where no data wiring, power wiring and primary batteries are required. Such configurations result in light weight installations that are relatively easy to install, simple to retrofit, and easily maintained. Another important point about the wireless, energy harvesting designs described herein is that such systems do not need to be wired into airplane power. The installation of the above described solutions enable an airline to install the sensing and monitoring devices in locations that may not have a readily available power source. Finally, methods of sensing that do not employ energy harvesting may be considered too costly or time consuming for airlines to implement.

It should also be noted that the above examples only, and that any of the described sensing mechanisms could be incorporated in any of the monitoring locations. For example, while the light bezel monitoring device is described as using a photovoltaic device, it is also possible to monitor the open/closed status of the bezel utilizing the above described piezoelectric device that is caused to deflect or vibrate by mechanical work, in this case the movement of the lighting bezel, thus producing an electrical charge in piezoelectric materials.

The embodiments are further intended to increase the efficiency of the above described inspection processes. In one example, those locations that have transmitted information indicated that some type of tampering has occurred, such as the opening of a light bezel or the removal of a return air grill, are the only locations subject to an extensive physical inspection before continued operation of the aircraft. Other locations may only need a periodic, cursory or visual inspection, thereby reducing the number of man-hours needed to fulfill search and inspection requirements.

While the above described embodiments are generally described in the context of employing energy harvesting devices for electrical power, it is also contemplated that embodiments of the described sensor/transmitter devices may utilize one or more primary batteries instead of, or in addition to, the energy harvesting capabilities.

Finally, while the described embodiments relate specifically to the energy harvesting techniques and the sensing of conditions, and the transmission of those conditions, it follows that certain embodiments include one or more receiving systems operable to receive the transmission from the sensor/transmitter, and that such a system is operable to record, store, and compile the data received from the transmitters. In one embodiment, the receiving system is operable to track the transmitters to ensure that they are active, and generate an indication if a transmitter is determined to be inactive. In such embodiments, a date and time stamp is generated by the receiving system. In conjunction with the receiving system, a user interface is contemplated from which a user can read, print, send, and/or relay the relevant sensor transmitter information as well as capture the resolution of the event(s) for a robust and traceable history.

While the invention has been described in terms of various specific embodiments, those skilled in the art will recognize that the invention can be practiced with modification within the spirit and scope of the claims.

What is claimed is:

1. A system for monitoring activities relating to movable and removable items within a vehicle, said system comprising:

an electrical energy storage device;

an energy harvesting device operable to store harvested energy in said electrical energy storage device, the energy harvesting device comprising a thermoelectric device exposed to a thermal gradient between two structures of the vehicle;

a sensor element configured to output signals corresponding to one or more of removal, installation, and a shift in position of a corresponding item within the vehicle; and a transmitter configured to receive the signals from said sensor element, said transmitter further configured to transmit unique identification information and data corresponding to the signals received from said sensor element, the unique identification information corresponding with a location of the item on the vehicle, said sensor element and said transmitter configured to use energy from one or both of said energy harvesting device and said electrical energy storage device, said transmitter further configured to periodically transmit the unique identification information on a periodic basis, whether or not a state of said sensor element changes, as a verification that said system is operable.

2. A system according to claim 1 wherein said electrical energy storage device comprises at least one of a capacitor and a battery.

3. A system according to claim 1 further comprising an actuator, at least one of the removal of the corresponding item, the installation of the corresponding item, a shift of position of the corresponding item, and an ambient condition associated with said system, configured to cause said actuator to operate said energy harvesting device.

4. A system according to claim 3 wherein said thermoelectric device is exposed to a thermal gradient between two aircraft structures.

5. A system according to claim 1 wherein said energy harvesting device is configured to convert energy from one or more of a force, a vibration, and a heat flow into electricity to power said sensor element and said transmitter.

6. A system according to claim 1 where the item is a light bezel and said system further comprises an actuator, said actuator configured to operate said sensor when the light bezel is moved from an open position to a closed position and when the light bezel is moved from a closed position to an open position.

7. A system according to claim 6 wherein said actuator comprises:

a magnet attached to the bezel; and a magnetically operable switch mounted in proximity said magnet when the light bezel is in a closed position, said switch configured to operate said sensor element.

8. A system according to claim 1 where the item is a door and said system further comprises an actuator, said actuator configured to operate said sensor element when the door is moved from an open position to a closed position and when the door is moved from a closed position to an open position, said actuator further configured to operate said energy harvesting device.

9. A system according to claim 8 wherein said actuator comprises at least one of:

a piezoelectric device that is caused to deflect or vibrate by the mechanical work of the door engaging or disengaging a door jamb, producing an electrical charge in a piezoelectric material;

an electro-dynamic device including a coil of wire, wherein a magnetic field is caused to move relative to the coil of wire to produce an electric current in the coil of wire by the opening and closing of the door;

a spring-loaded lever that is operated when the door is opened or when the door is closed;

a micro-switch that is operated when the door is opened or when the door is closed; and a magnetic reed relay mounted to one of the door and a door jamb, and a magnet bonded to the opposite one of the door and the door jamb.

10. A system according to claim 1 where the item is an airplane seat cushion, said system further comprises an actuator, said actuator configured to operate said sensor element and said energy harvesting device upon at least one of full removal, partial removal, movement, vibration, and installation of the airplane seat cushion with respect to an aircraft seat frame.

11. A system according to claim 10 wherein said actuator comprises a lever attached to a seat pan of an airplane seat frame, the seat pan located under an installation position for the airplane seat cushion.

12. A system according to claim 11 wherein said lever comprises:

a first land configured to engage and activate said energy harvesting device and activate said sensor element, causing said transmitter to transmit; and a second land configured to rest upon a surface of said sensor element and said transmitter, such that vertical loads from the airplane seat cushion are carried through to the seat pan.

13. A system according to claim 10 wherein said actuator comprises at least one of a cantilevered piezoelectric beam and an electro-dynamic harvester, such that seat vibration causes said actuator to operate said energy harvesting device.

14. A system according to claim 10 wherein said actuator comprises:

a membrane attached to a seat pan of an airplane seat frame, said membrane comprising a plunger, said membrane and said plunger responsive to a pressure applied through the airplane seat cushion; and a micro-switch operated by said plunger, said micro-switch electrically connected to said sensor element.

15. A system according to claim 1 where the item is an air flow grill, said system further comprises an actuator, said actuator configured to operate said sensor element upon at least one of full removal, partial removal, movement, and installation of the air flow grill with respect to an aircraft cabin wall.

16. A system according to claim 15 wherein said actuator comprises:

a magnetic reed switch; and a magnet, one of said magnetic reed switch and said magnet mounted to the air flow grill and the opposite one of said magnetic reed switch and said magnet mounted to the aircraft cabin wall such that said magnet causes said magnetic reed switch to close while the air flow grill is installed on the aircraft cabin wall.

17. A system according to claim 15 wherein said energy harvesting device comprises a thermoelectric generator located within an airplane structure proximate the air flow grill.

18. A method for monitoring activities related to one or more items within an aircraft, said method comprising:

configuring the items such that at least one activity associated with the item is operable to power a sensor using a thermoelectric energy harvesting device exposed to a thermal gradient across an insulation blanket of the aircraft;

transmitting a unique identification code on a periodic basis, whether or not a state of the sensor changes, as a verification that the sensor and the energy harvesting device are operable, the unique identification code indicating whether or not a triggering event has occurred; and correlating the unique identification code with a physical location within an aircraft for purposes of physical inspection.

19. A system for monitoring activities relating to movable and removable items within a structure, said system comprising:

an electrical energy storage device;

an energy harvesting device operable to store harvested energy in said electrical energy storage device, the energy harvesting device comprising a thermoelectric generator exposed to a thermal gradient across at least one of a hydraulic line and an insulation blanket;

a sensor element configured to output signals corresponding to one or more of removal, installation, and a shift in position of a corresponding item within the structure; and a transmitter configured to receive the signals from said sensor element, said transmitter further configured to transmit unique identification information and data corresponding to the signals received from said sensor element, the unique identification information corresponding with a location of the item on the structure, said sensor element and said transmitter configured to use energy from one or both of said energy harvesting device and said electrical energy storage device, said transmitter further configured to periodically transmit the unique identification information on a periodic basis, whether or not a state of said sensor element changes, as a verification that said system is operable.

20. A system according to claim 1, wherein the energy harvesting device is a first energy harvesting device, the system comprising a second energy harvesting device including at least one of;

a vibration harvesting device;

a cantilevered piezoelectric beam, exposed to airplane or operational vibration; and a piezoelectric material bonded to an aircraft structure, said piezoelectric material operable to undergo a strain based on a strain experienced by the aircraft structure under varying aircraft operational forces.

* * * * *